US010167626B1

(12) United States Patent
Marwood

(10) Patent No.: US 10,167,626 B1
(45) Date of Patent: Jan. 1, 2019

(54) MASONRY SUPPORT APPARATUS

(71) Applicant: Robert Marwood, Langley (CA)

(72) Inventor: Robert Marwood, Langley (CA)

(73) Assignee: THERMO BAR LTD., Langley, B. C. (CA)

( * ) Notice: Subject to any disclaimer, the term of this patent is extended or adjusted under 35 U.S.C. 154(b) by 0 days.

(21) Appl. No.: 15/829,292

(22) Filed: Dec. 1, 2017

(51) Int. Cl.

| | |
|---|---|
| ***E04B 1/41*** | (2006.01) |
| ***E04B 1/76*** | (2006.01) |
| ***E04B 2/30*** | (2006.01) |
| ***E04F 13/08*** | (2006.01) |
| *E04B 1/38* | (2006.01) |
| *E04B 2/56* | (2006.01) |

(52) U.S. Cl.
CPC ..... *E04B 1/4178* (2013.01); *E04B 1/41* (2013.01); *E04B 1/762* (2013.01); *E04B 1/7612* (2013.01); *E04B 1/7616* (2013.01); *E04B 2/30* (2013.01); *E04F 13/0801* (2013.01); *E04F 13/0832* (2013.01); *E04B 2001/405* (2013.01); *E04B 2002/565* (2013.01)

(58) Field of Classification Search
CPC ... E04B 1/40; E04B 1/41; E04B 1/762; E04B 2001/405; E04B 1/4178; E04B 1/7616; E04B 1/4185; E04B 1/7612; E04B 1/7629; E04B 2002/565; E04B 2/30; E04F 13/0801; E04F 13/0832
See application file for complete search history.

(56) References Cited

U.S. PATENT DOCUMENTS

| | | | | | |
|---|---|---|---|---|---|
| 960,043 | A * | 5/1910 | Seldon | E04B 2/30 | 52/428 |
| RE15,979 | E * | 1/1925 | Schaefer | E04B 1/4178 | 52/379 |
| 1,695,909 | A * | 12/1928 | Bauer | E04B 1/4178 | 52/379 |
| 1,709,988 | A * | 4/1929 | Lampert | E04B 1/4178 | 52/564 |
| 1,725,200 | A * | 8/1929 | Lampert | E04B 1/4178 | 52/379 |
| 2,075,262 | A * | 3/1937 | Boettner | E04B 1/4107 | 52/699 |
| 2,183,712 | A * | 12/1939 | Dunlap | E04B 1/4178 | 52/379 |

(Continued)

FOREIGN PATENT DOCUMENTS

CA 2254510 A1 * 5/2000 ..... E04B 1/4178

*Primary Examiner* — Adriana Figueroa
*Assistant Examiner* — Jessie T Fonseca
(74) *Attorney, Agent, or Firm* — Jeffer Mangels Butler & Mitchell LLP; Brennan C. Swain, Esq.

(57) ABSTRACT

A masonry support apparatus supports a wall of brick or other masonry material in a building, provides a thermal break between the wall and a concrete floor of the building, and secures insulation material between the wall and the floor. The masonry support apparatus comprises an elongated longitudinally extending support member, at least one insulation bracket assembly extending rearwardly from the support member for securing an insulation block, and at least one concrete anchor extending rearwardly from the insulation bracket assembly for securing to a concrete floor. The support member, insulation bracket assembly and concrete anchor are permanently joined together to form a unitary structure.

7 Claims, 6 Drawing Sheets

(56) References Cited

U.S. PATENT DOCUMENTS 4,021,990 A * 5/1977 Schwalberg ..... E04B 1/4178 52/379
4,827,684 A * 5/1989 Allan ..... E04B 1/4178 52/378
4,843,776 A * 7/1989 Guignard ..... E04B 1/4178 52/434
4,852,320 A * 8/1989 Ballantyne ..... E04B 1/4178 52/302.3
5,035,099 A * 7/1991 Lapish ..... E04F 13/0808 52/565
5,207,043 A * 5/1993 McGee ..... E04B 1/4178 52/379
5,816,008 A * 10/1998 Hohmann ..... E04B 1/4178 52/565
6,128,883 A * 10/2000 Hatzinikolas ..... E04B 1/4178 52/378
6,212,841 B1 * 4/2001 Plume ..... E04B 1/4178 52/379
6,332,300 B1 * 12/2001 Wakai ..... E04B 1/4178 52/379
6,789,365 B1 * 9/2004 Hohmann ..... E04B 1/4185 52/309.11
7,017,318 B1 * 3/2006 Hohmann ..... E04B 1/4185 52/379
7,225,590 B1 * 6/2007 diGirolamo ..... E04B 1/4178 52/379
7,325,366 B1 * 2/2008 Hohmann, Jr. ..... E04B 1/4178 52/167.1
8,667,757 B1 * 3/2014 Hohmann, Jr. ..... E04F 13/0805 52/379
9,260,855 B2 * 2/2016 Farahmandpour .... E04B 1/7616
9,316,004 B1 * 4/2016 Hatzinikolas ..... F16M 13/02
9,758,958 B2 * 9/2017 Hohmann, Jr. ..... E04B 1/4178
2003/0188499 A1 * 10/2003 Bronner ..... E04B 1/4178 52/378
2006/0005490 A1 * 1/2006 Hohmann, Jr. ..... E04B 1/4178 52/293.3
2008/0092472 A1 * 4/2008 Doerr ..... E04B 1/4178 52/379
2008/0115439 A1 * 5/2008 Tamlyn ..... E04B 1/4178 52/379
2008/0296451 A1 * 12/2008 Yoshida ..... E04F 13/0808 248/220.1
2010/0229489 A1 * 9/2010 Riepe ..... E04B 1/4178 52/489.2
2010/0257803 A1 * 10/2010 Hohmann, Jr. ..... E04B 1/4178 52/405.1
2012/0186183 A1 * 7/2012 Johnson, III ..... E04B 1/4185 52/565
2012/0285111 A1 * 11/2012 Johnson, III ..... E04B 1/4178 52/379
2012/0291390 A1 * 11/2012 Hohmann, Jr. ..... E04B 1/4178 52/565
2013/0247498 A1 * 9/2013 Hohmann, Jr. ..... E04B 1/4178 52/582.1
2014/0250809 A1 * 9/2014 Hohmann, Jr. ..... E04B 1/4178 52/309.1
2014/0311071 A1 * 10/2014 Curtis ..... E04B 1/4185 52/309.1
2015/0121792 A1 * 5/2015 Spoo ..... E04B 1/4178 52/483.1
2016/0153198 A1 * 6/2016 Hatzinikolas ..... E04B 1/40 52/702
2017/0284104 A1 * 10/2017 Hatzinikolas ..... E04F 13/0801

* cited by examiner

MASONRY SUPPORT APPARATUS

FIELD

The present disclosure relates generally to a masonry support apparatus for use in building construction.

BACKGROUND

Known methods for constructing a wall of brick and other masonry material in a building include laying brick on a metal support member located at the bottom of the wall. The support member can engage a series of support brackets which are secured by anchors to a rigid structure of the building, such as to a concrete foundation. As example of such a method is disclosed in U.S. Pat. No. 9,316,004.

Execution of known masonry wall construction methods is laborious, time intensive and requires a not insignificant amount of technical skill. For instance, careful attention and experience is required to accurately space the support brackets such that they line up with connectors in the support member. Further, it is time consuming to thread the anchors through the brackets and then care must be taken to correctly align each bracket while the concrete foundation is poured in place. If the angle of the bracket is not properly aligned, or the bracket is not properly spaced relative to adjacent brackets, then the support member may not engage securely, or at all, to the brackets. Furthermore, improperly installed anchors, brackets and support members make it challenging to install other parts of the wall, such as insulation material.

It is therefore desirable to provide a solution to at least some of the challenges faced by prior art methods for constructing masonry walls.

SUMMARY

According to one aspect, there is provided a masonry support apparatus comprising an elongated longitudinally extending support member, at least one insulation bracket assembly extending rearwardly from the support member, and at least one concrete anchor extending rearwardly from the insulation bracket assembly. The support member has a horizontal section for supporting masonry material and a vertical section extending generally perpendicularly upwards from the horizontal section. Each insulation bracket assembly comprises a pair of longitudinally spaced lateral members that extend rearwardly from the vertical section of the elongated support member, and at least one longitudinal member that extends longitudinally from at least one of the lateral members, such that the insulation bracket assembly defines a receptacle for matingly receiving an insulation block. The support member, insulation bracket assembly and concrete anchor are permanently joined together to form a unitary structure.

The masonry support apparatus can further comprise at least two insulation bracket assemblies, wherein a pair of adjacent insulation bracket assemblies are longitudinally spaced apart by a distance corresponding to the insulation block. At least one of the insulation bracket assemblies can comprise two longitudinal members, wherein each longitudinal member is attached to a respective lateral member which extends longitudinally towards the other longitudinal member. Alternatively, at least one insulation bracket assembly can comprise one longitudinal member attached to and extending between the pair of lateral members.

According to another aspect, the ends of two elongated longitudinally extending masonry apparatuses can joined together at an angle to form a corner piece. The angle can be substantially 90 degrees.

This summary does not necessarily describe the entire scope of all aspects. Other aspects, features and advantages will be apparent to those of ordinary skill in the art upon review of the following description of specific embodiments.

DETAILED DESCRIPTION

Embodiments described herein relate generally to a masonry support apparatus for supporting a wall of masonry material in a building, to provide a thermal break between the wall and a concrete floor of the building, and to secure insulation material between the wall and the floor. The masonry material can include but is not limited to brick veneer, stone veneer and concrete blocks. The masonry support apparatus is intended for installation on one or more floors of a building, and multiple pieces of the masonry support apparatus can be assembled to define a perimeter of a concrete foundation of the building floor. The masonry support apparatus can have a number of embodiments, including an elongated straight piece embodiment and a 90 degree corner piece embodiment.

In this description, directional terms such as "upward", "rearward", "horizontal" and "vertical" are used to provide relative reference only and to assist the reader in understanding the embodiments described herein, and are not intended to restrict the orientation of any structure or its use relative to the environment.

For convenient reference in this description, the masonry support apparatus described herein has a longitudinal dimension that is parallel to a length of a brick support member of the apparatus, a lateral dimension that is parallel to a width of the brick support member, and a vertical dimension that is parallel to a height of the brick support member.

Figure 3:
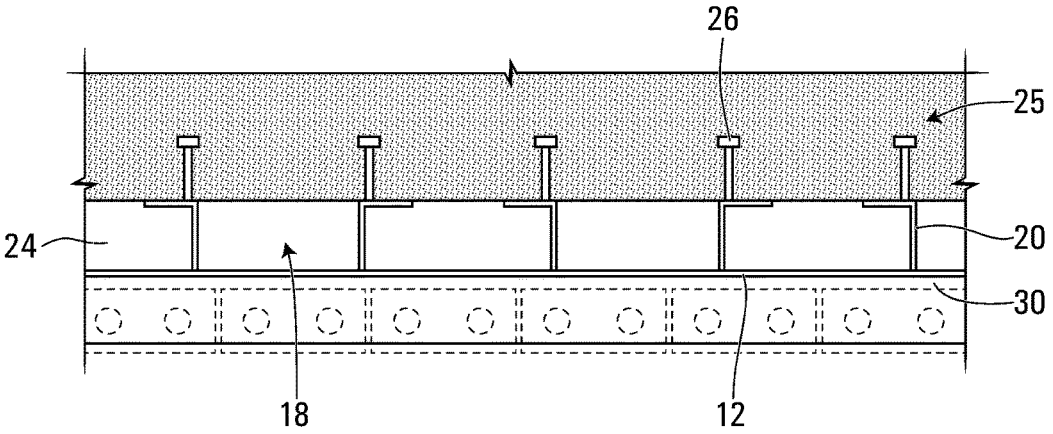
FIG. 3 is a top plan view of the masonry support apparatus shown in FIG. 2.
Figure 4:
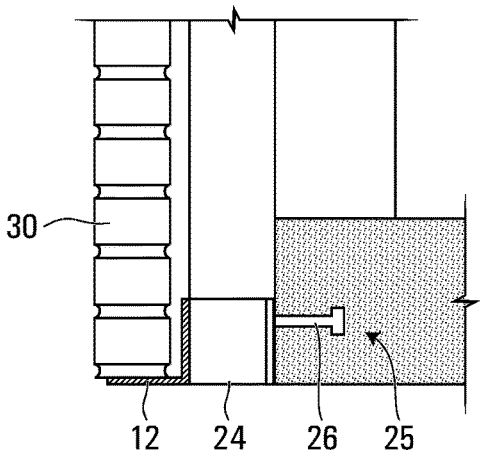
FIG. 4 is a side sectioned view of the masonry support apparatus with integral anchors secured in a concrete foundation, and with insulation brackets securing a row of insulation blocks.
Figure 5:
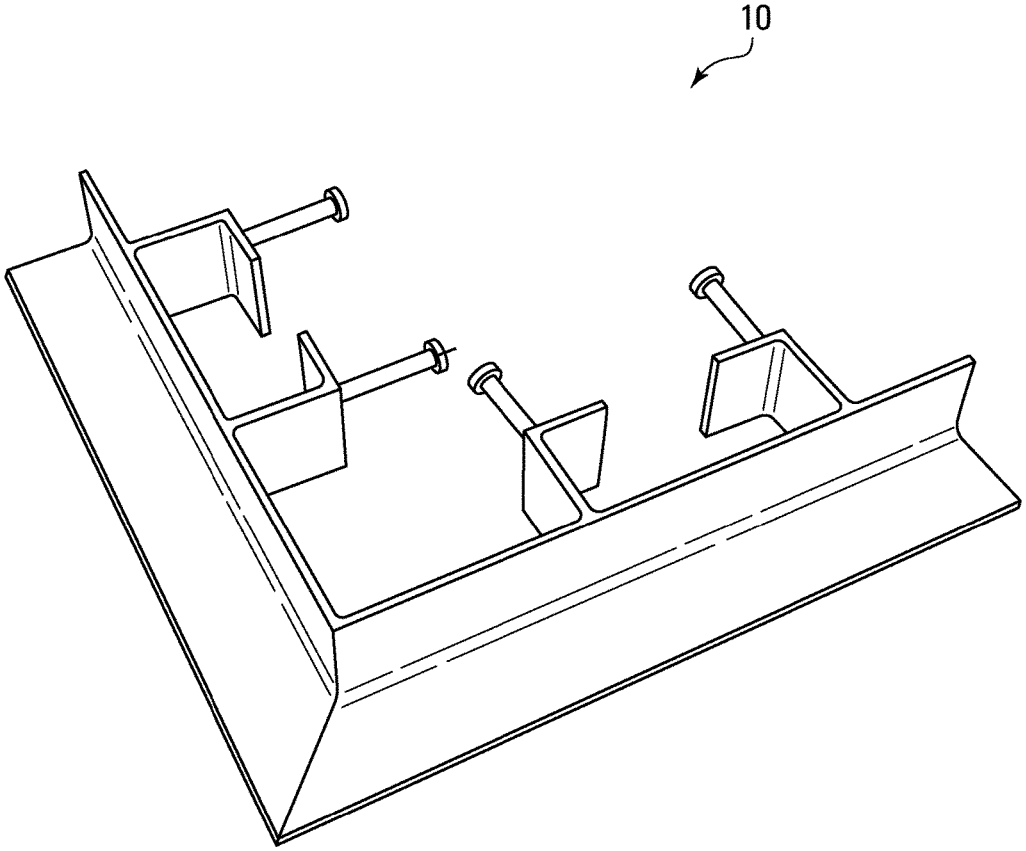
FIG. 5 is a perspective view of a corner embodiment of the masonry support apparatus.

FIGS. 1 to 4 show an elongated straight embodiment of the masonry support apparatus 10, and FIG. 5 shows a 90 degree corner embodiment of same. The masonry support apparatus 10 comprises a brick support member 12, which has a horizontal section 14 and a vertical section 16 extending upwardly from a rear edge of the horizontal section 14. The length of the brick support member 12 can be varied, and for the example can be 10 feet for the elongated straight piece embodiment, and can be 2 feet for each leg of the 90 degree corner piece embodiment. The width of the brick support member 12 should be sufficient to fully support the typical 3½ inch width of veneer and structural bricks, and for example can be 4 inches. The height of the brick support member 12 can be varied, and for example can be 4 inches. A suitable material for the brick support member 12 is a ¼" thick galvanized iron angle bar; however, other suitable materials known to one skilled in the art can be substituted.

The masonry support apparatus 10 also comprises one or more insulation brackets 18 attached to the rear of the brick support member 12, and longitudinally spaced along the length of the brick support member 12 to matingly receive insulation blocks. Each insulation bracket 18 comprises a pair of longitudinally spaced angle members each comprising a lateral member 20 and a longitudinal member 22 joined together to form a 90 degree angle. Each lateral member 20 extends rearwardly from the vertical section 16 of the brick support member 12. The lateral members 20 have a longitudinally spacing sufficient to receive the length of an insulation block 24 there-between. Each longitudinal member 22 extends longitudinally towards the other from the rear edge of each lateral member 20, and terminates such that a longitudinal gap is defined. The pair of angle members 20, 22 of each insulation bracket 18 define a generally rectangular space that is sized to matingly receive the insulation block 24. The angle members 20, 22 can be made of the same material as the brick support member 12, and for example, can be galvanized iron angle bars. The angle members 20, 22 can be welded in a vertical orientation to the rear of the vertical section 18 of the brick support member 12.

Figure 1A:
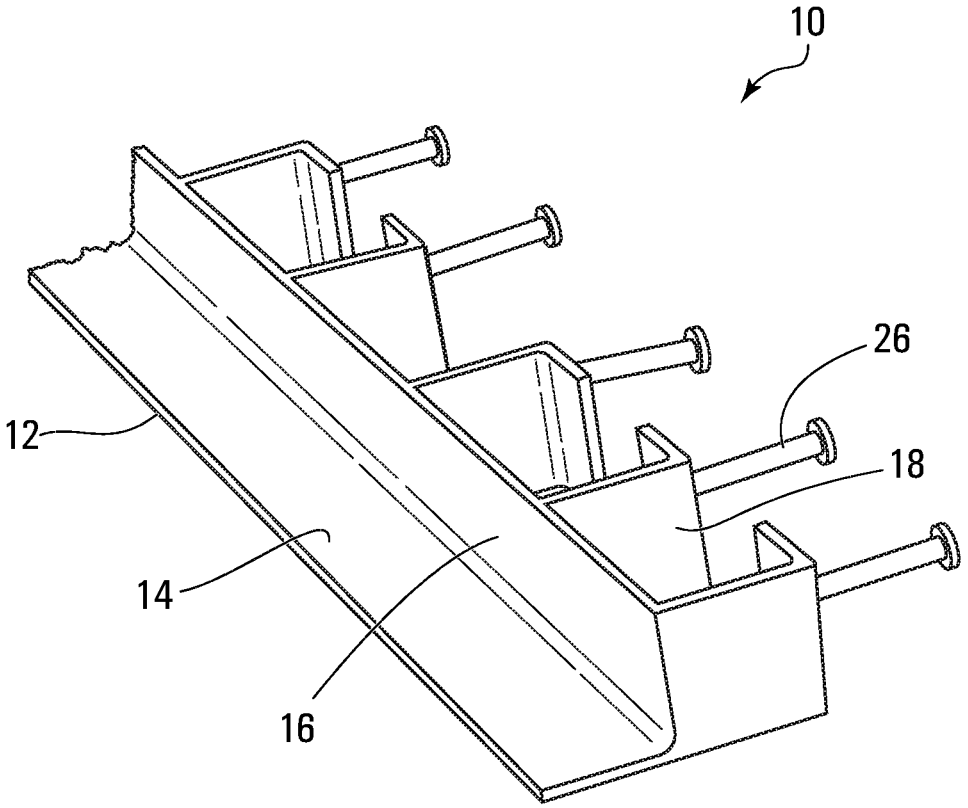
FIGS. 1(*a*) and (*b*) are front and rear perspective views of a straight embodiment of a masonry support apparatus.
Figure 1B:
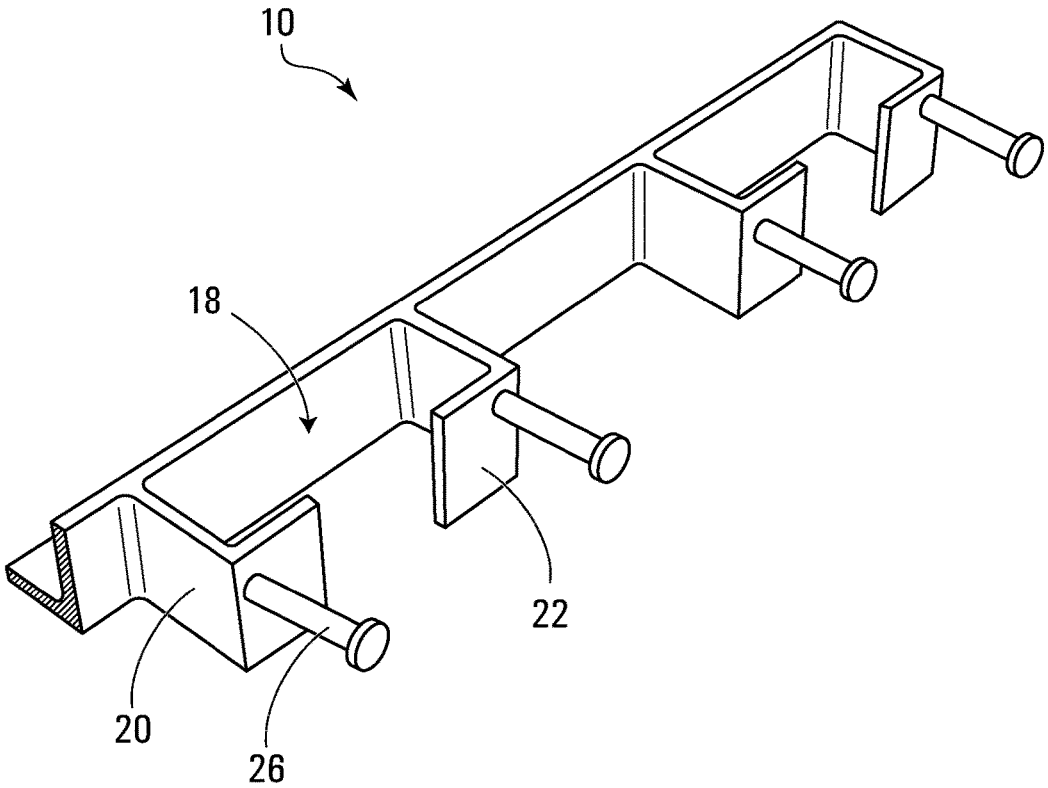
Figure 2:
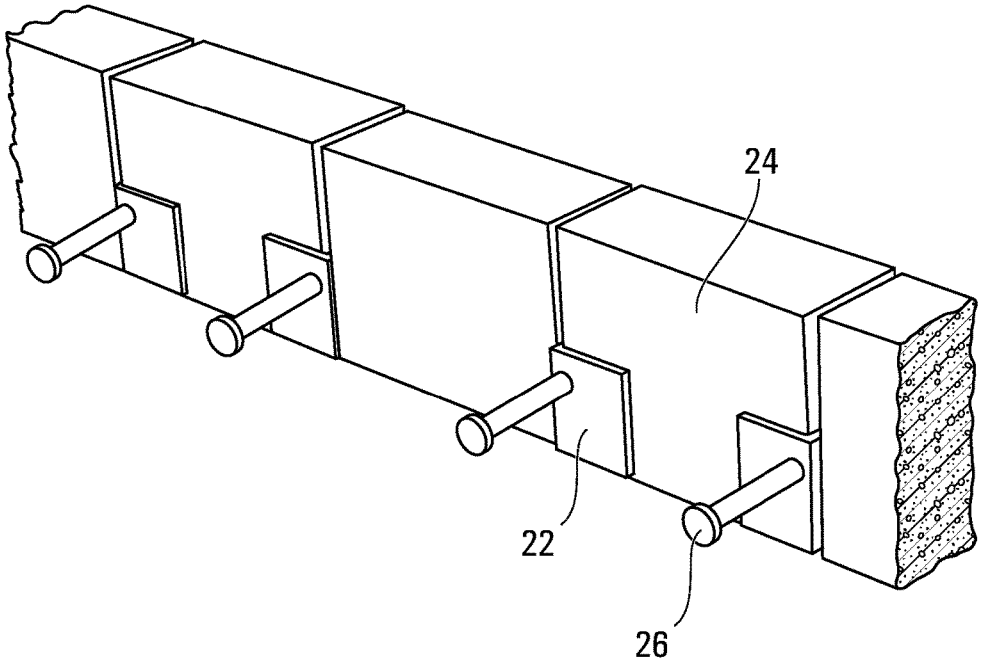
FIG. 2 is a rear perspective view of the masonry support apparatus securing a row of insulation blocks.

As can be seen in FIGS. 1(*b*) and 2, a pair of adjacent insulation brackets 18 can be spaced from each other so that an insulation block 24 can be matingly fit in between the insulation brackets 18. The insulation blocks typically vary from 1" to 6" in thickness, and the size of the brackets 18 can be adjusted accordingly.

The masonry support apparatus 10 also comprises at least one anchor for securing the apparatus 10 to a secure fixture in the building. In the illustrated embodiments, the masonry support apparatus 10 comprises multiple concrete anchors 26, with each concrete anchor 26 extending rearwardly from the longitudinal member 22 of each insulation bracket angle member. In some embodiments, the concrete anchor 26 can be a Nelson stud welded to the back side of the longitudinal member 22. The concrete anchors 26 are used to anchor the masonry support apparatus 10 to a building floor, e.g. by being embedded in the concrete forming the floor.

The insulation brackets create a thermal break between a brick wall constructed on the brick support member 12 and a concrete floor, and the insulation blocks 24 impede heat from escaping the building, whether by radiation, convection, or conduction. However, heat can still be transmitted relatively easily through the metal structure of the masonry support apparatus. To minimize conductive heat loss, the masonry support apparatus 10 can be configured with a minimal cross section across the thermal break, and in particular, the lateral members 20 of the insulation brackets 18 can comprise relatively thin vertical plates. Further, the longitudinal members 22 of the insulation brackets 18 can have a small surface area that minimizes contact with the concrete floor but which are still large enough to secure the insulation blocks in place.

Preferably, the brick support member 12, insulation bracket(s) 18 and concrete anchors 26 are permanently attached together, e.g. by welding, to form a unitary structure. As will be described below, providing a unitary structure is expected to substantially simplify and quicken installation of the masonry support apparatus 10, compared to prior art masonry support products, which comprise separate components.

Figure 6:
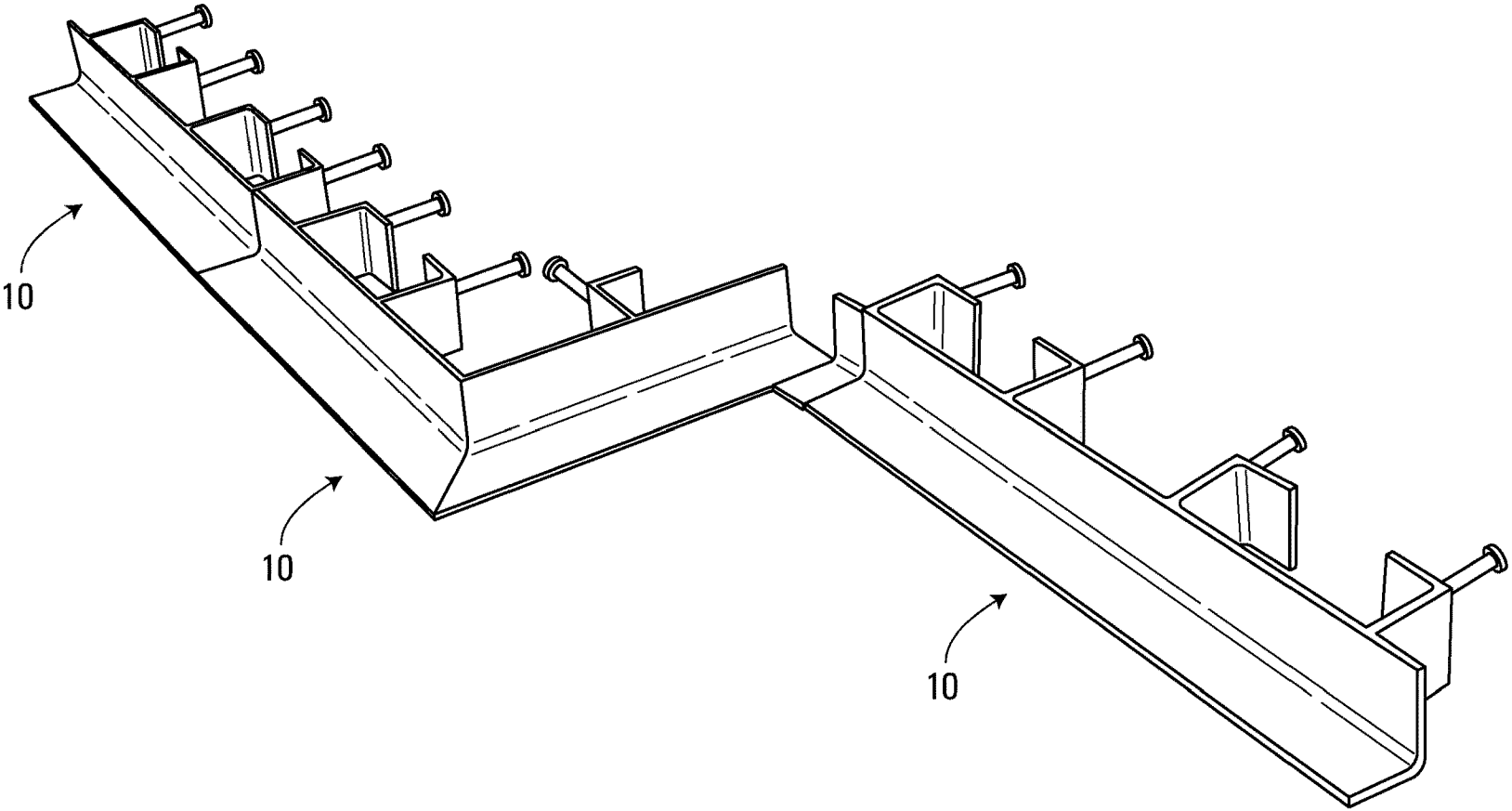
FIG. 6 is a perspective view of a collection of straight and corner embodiments of the masonry support apparatus that collectively form a perimeter for a concrete floor.

In use and referring to FIGS. 3, 4 and 6, multiple pieces of the masonry support apparatus 10 can be arranged end to end to form a mold for the concrete floor. The pieces of the masonry support apparatus 10 are positioned so that the concrete anchors 26 extend into the mold. A first row of insulation blocks 25 are then inserted into each insulation bracket 18 and in between each insulation bracket 18. Concrete is then poured into the mold until the concrete anchors 26 are covered and a concrete floor 25 is formed. Once the concrete cures, the concrete anchors 26 are securely embedded into the concrete floor 25, and the insulation blocks 24 are securely in place. Then, rows of bricks 30 can be laid onto the brick support member 12 in the manner known in the art.

In contrast to prior art techniques, installing the masonry support apparatus 10 is quick and simple. Because the masonry support apparatus 10 is a unitary structure, there is no need to perform multiple installation steps of setting support brackets, threading anchors, and mounting a support beam. Furthermore, the unitary structure means that the masonry support apparatus 10 is always precisely aligned, such that brick and insulation blocks can be easily installed.

The terminology used herein is for the purpose of describing particular embodiments only and is not intended to be limiting. Accordingly, as used herein, the singular forms "a", "an" and "the" are intended to include the plural forms as well, unless the context clearly indicates otherwise. It will be further understood that the terms "comprises" and "comprising," when used in this specification, specify the presence of one or more stated features, integers, steps, operations, elements, and components, but do not preclude the presence or addition of one or more other features, integers, steps, operations, elements, components, and groups. Directional terms such as "top", "bottom", "upwards", "downwards", "vertically", and "laterally" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

It is contemplated that any part of any aspect or embodiment discussed in this specification can be implemented or combined with any part of any other aspect or embodiment discussed in this specification.

The scope of the claims should not be limited by the preferred embodiments set forth in the examples, but should be given the broadest interpretation consistent with the description as a whole.

What is claimed is:

1. A masonry support apparatus comprising:

(a) an elongated longitudinally extending support member having a horizontal section for supporting masonry material, and a vertical section extending generally perpendicularly from the horizontal section;

(b) at least two insulation bracket assemblies, wherein each insulation bracket assembly comprises a pair of longitudinally spaced lateral members extending rearwardly from the vertical section of the elongated support member, and at least one longitudinal member extending longitudinally from at least one of the lateral members, such that the insulation bracket assembly defines a receptacle for matingly receiving an insulation block, and wherein a pair of adjacent insulation bracket assemblies are longitudinally spaced apart by a distance corresponding to the insulation block; and (c) at least one concrete anchor extending rearwardly from the at least one longitudinal member of the at least one insulation bracket assembly;

wherein the support member, insulation bracket assembly and concrete anchor are permanently joined together to form a unitary structure.

2. The masonry support apparatus as claimed in claim 1 wherein at least one of the at least two insulation bracket assemblies comprises two longitudinal members, each longitudinal member attached to a respective one of the lateral members and extending longitudinally towards the other longitudinal member.

3. The masonry support apparatus as claimed in claim 1 wherein at least one of the at least two insulation bracket assemblies comprises one longitudinal member attached to and extending between the pair of lateral members.

4. The masonry support apparatus as claimed in claim 2 wherein at least one of the at least two insulation bracket assemblies comprises two concrete anchors.

5. The masonry support apparatus as claimed in claim 2 wherein the concrete anchor is a Nelson stud.

6. A masonry support apparatus assembly, comprising a pair of masonry support apparatuses as claimed in claim 1, joined together at a respective end to form an angle.

7. The masonry support apparatus assembly as claimed in claim 6 wherein the angle is substantially 90 degrees.

* * * * *